US005205417A

United States Patent [19]

Herren

[11] Patent Number: 5,205,417

[45] Date of Patent: Apr. 27, 1993

[54] SANITARY TRASH RECYCLING APPARATUS

[76] Inventor: John T. Herren, 1001 River Rd., Farmville, Va. 23901

[21] Appl. No.: 803,951

[22] Filed: Dec. 9, 1991

[51] Int. Cl.[5] ..... B07C 7/04

[52] U.S. Cl. ..... 209/630; 198/346; 198/637; 209/705; 209/930; 209/933

[58] Field of Search ..... 209/702, 705, 630, 930, 209/933, 942; 198/346, 637

[56] References Cited

U.S. PATENT DOCUMENTS

| | | | |
|---|---|---|---|
| 1,847,264 | 3/1932 | Sandberg | 209/933 X |
| 1,884,101 | 10/1932 | Moe | 209/705 |
| 1,936,116 | 11/1933 | Nyberg | 209/705 |
| 2,183,884 | 12/1939 | Hait | 209/705 |
| 2,257,567 | 9/1941 | Matanovich-Manov et al. | 209/930 |
| 3,232,425 | 2/1966 | Le Van Hansen et al. . | |
| 3,595,389 | 7/1971 | Morgan | 209/705 |
| 3,643,797 | 2/1972 | Berkowitz et al. . | |
| 4,139,454 | 2/1979 | Larson . | |
| 4,929,342 | 5/1990 | Johnston . | |
| 5,100,537 | 3/1992 | Krause | 209/705 X |
| 5,101,977 | 4/1992 | Roman | 209/930 X |

FOREIGN PATENT DOCUMENTS

| | | | |
|---|---|---|---|
| 2610546 | 8/1988 | France | 209/705 |

*Primary Examiner*—Donald T. Hajec
*Attorney, Agent, or Firm*—Henderson & Sturm

[57] ABSTRACT

A sanitary trash recycling apparatus includes a pit for receiving unsorted refuse, a electromagnetic device for removing ferrous materials and stations for permitting manual sorting of recyclable materials. The stations for manually sorting materials includes a device for moving the material to be sorted out toward the sorting operators as it moves through the station. A plurality of chutes are provided for each one of a number of recyclable products and bins are provided for receiving the sorted materials.

17 Claims, 2 Drawing Sheets

SANITARY TRASH RECYCLING APPARATUS

TECHNICAL FIELD

The present invention relates generally to a sanitary trash recycling apparatus and more particularly to such an apparatus which facilitates manual sorting of recyclable refuse in an uncomplicated and economical fashion.

BACKGROUND ART

While almost everyone agrees that it is desirable to recycle certain products such as plastic bottles, aluminum cans and other recyclable materials, recycling will never become a common practice until and unless it becomes economical to do so.

Because previous sorting operations have been too expensive by virtue of either the expense of the machinery used therein or the amount of manual labor required in the sorting process, recycling of recyclable materials has not become as widespread as is now possible.

DISCLOSURE OF THE INVENTION

The present invention relates generally to a sanitary trash recycling apparatus having a conveyor belt for receiving refuse at one end thereof and moving it toward the other end thereof and having a tapered device disposed above the conveyor belt for causing the refuse to move outwardly from the conveyor belt as refuse is moved along so that persons disposed adjacent to the conveyor belt can readily see and grasp recyclable products and allow non-recyclable products to continue on the conveyor belt. A transparent shield is disposed over the conveyor belt and holes are provided therein for permitting people to reach through the shield, grasp recyclable products with gloved hands and place them in one or more of a plurality of chutes designated for individual recyclable products.

The chutes have closures on the bottom end thereof and bins are disposed below the chutes so that when the bins are full of a certain type of recyclable product, they can be emptied and materials will accumulate in the chutes until the bin is replaced and the closure opened.

A pit is provided for receiving unsorted refuse and a conveyor is provided for moving the unsorted refuse first to a device for electromagnetically removing ferrous materials therefrom and then further moving the unsorted refuse onto the aforementioned conveyor belt.

The pit and its associated sanitary trash recycling unit are preferably disposed in a larger building for screening the operation from public view, preventing trash from blowing from the premises and minimizing odors which might otherwise eminate therefrom. This also provides storage space for sorted items.

An object of the present invention is to provide an improved sanitary trash recycling apparatus.

A further object of the present invention is to provide a sanitary trash recycling apparatus that is economical to produce and operate.

Other objects, advantages, and novel features of the present invention will become apparent from the following detailed description of the invention when considered in conjunction with the accompanying drawings.

BEST MODE FOR CARRYING OUT THE INVENTION

Figure 1:
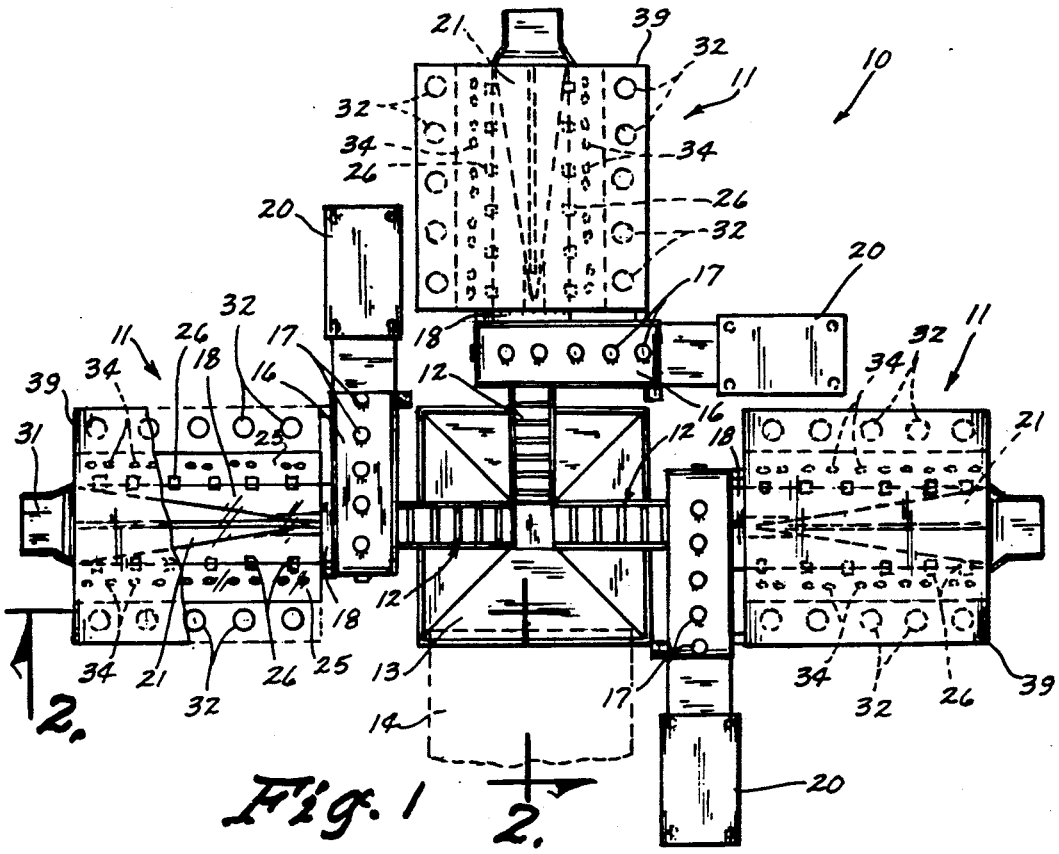
FIG. 1 is a top plan view of a plurality of sanitary trash recycling units used in conjunction with a single pit for receiving unsorted refuse.

Referring now to the drawings wherein like reference numerals designate identical or corresponding parts throughout the several views, FIG. 1 shows an apparatus (10) constructed in accordance with the present invention having three sanitary trash recycling units (11) attached by conveyor belts (12) to a common pit (13).

Figure 2:
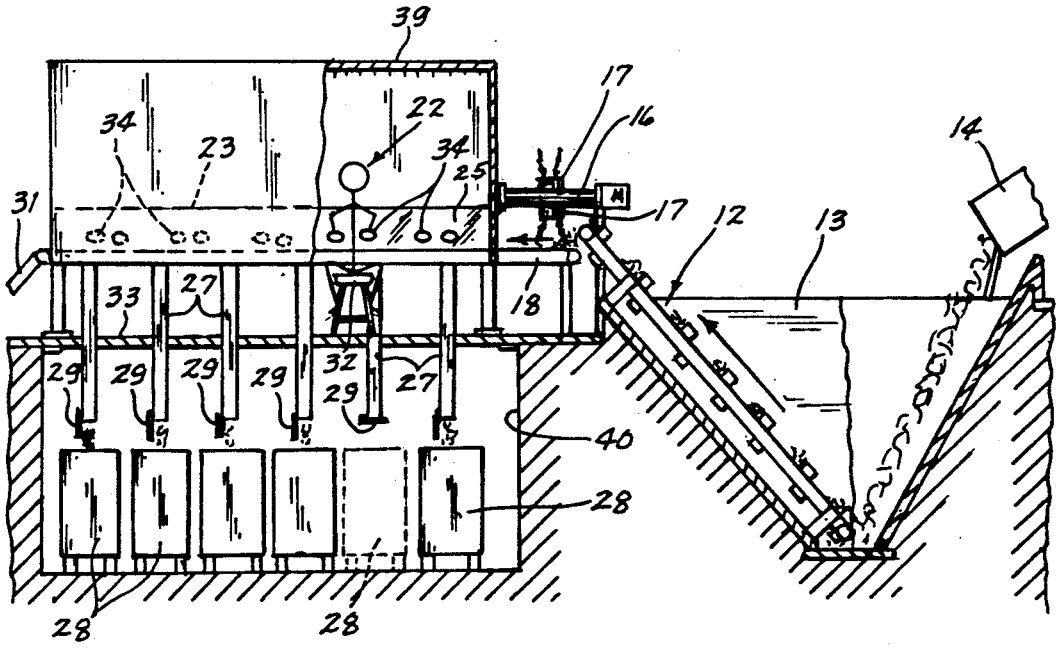
FIG. 2 is an enlarged cross sectional view taken along 2—2 of FIG. 1.

The pit (13) has three flat sloping sides, as is shown in FIGS. 1 and 2, and one side is vertical so that a truck (14), shown in dashed lines in FIG. 1, can dump unsorted refuse into the pit (13). Of course, refuse could be dumped into the pit (13) in many other ways.

The conveyor apparatus (12) extends from the bottom of the pit (13) under conveyor belt (16) having electromagnetic devices (17) disposed thereon for holding items made of ferrous materials and causing them to move onto the electromagnetic conveyor (16) where they are then released. Removing ferrous materials will loosen up the remaining trash for easier sorting. These ferrous materials can be sorted on table (20) into categories such as stainless, bi-metal cans, tin cans, light steel, cast iron, etc.

Figure 3:
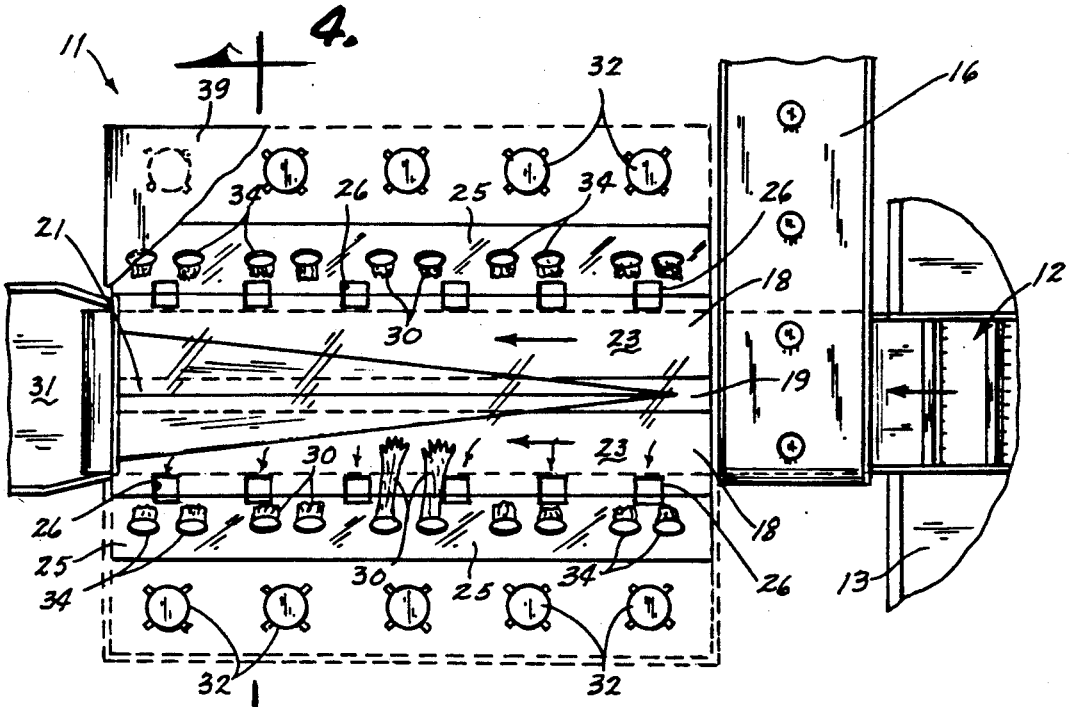
FIG. 3 is an enlarged portion of one of the units shown in FIG. 1.
Figure 4:
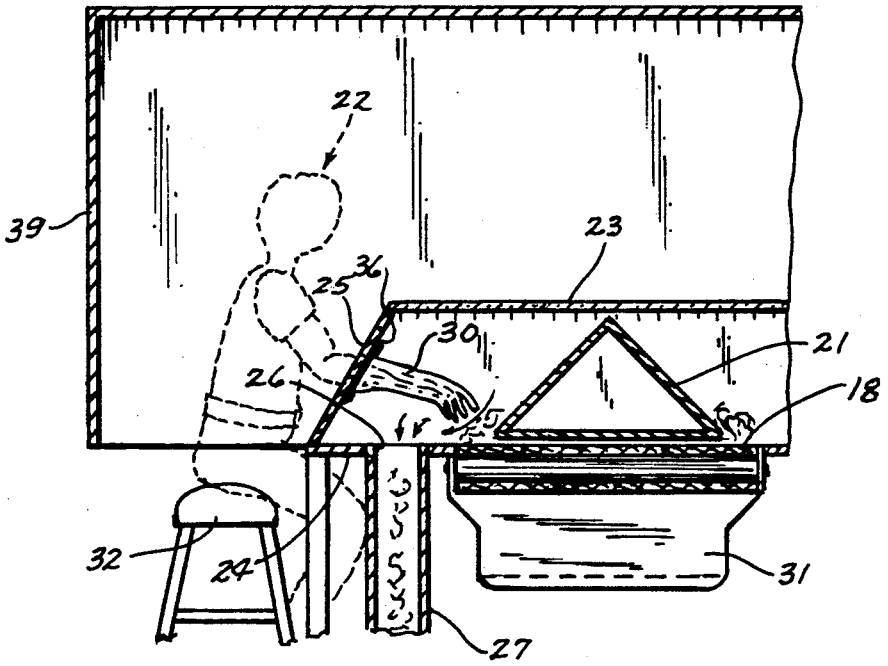
FIG. 4 is an enlarged cross sectional view taken along line 4—4 of FIG. 3.

The materials from pit (13) which are not ferrous will be forced on into the main conveyor chamber consisting of two conveyor belts (18) which are substantially identical and are disposed on each side of a divider (19) (see FIG. 3). Attached to the divider (19) and held up above the conveyor belts (18) is a tapered member (21). This tapered member (21) is substantially triangular in cross section along the length thereof, as is shown in FIG. 4, and the function of this tapered device is to force refuse travelling on the conveyor belts (18) to move outwardly as it is moved by the conveyor belts (18) from one end of conveyor (18) to the other end thereof. This tapered divider (21) also causes a somewhat tumbling effect as the refuse moves up onto divider (21) as it moves to the left in FIG. 3 to further permit a person (22) (shown in FIG. 4) to sort the refuse, as will be explained further below.

A transparent shield (23) is formed around and over the conveyor belts (18) and over the tapered device (21). To each side of the conveyor belts (18) is a shelf (24) having openings (26) therein leading to chutes (27). These chutes (27), as shown in FIG. 2, have bins (28) disposed therebelow and they also have a slide gate or pivoted closure member (29) thereon which can be selectively either opened or closed. A chute (31) is provided to receive all refuse which is not otherwise removed by the ferro-magnetic sorter or by the manual sorting process and this chute (31) is preferably arranged such that it will drop the remainder into a truck or the like for removal to a landfill or to another suitable place, e.g. to a W.T.E. plant.

Backed stools (32) are provided on top of a floor (33), as shown in FIG. 2. A plurality of openings (34) in wall (25) of shield (23) have closure seals (36) thereon so that a person, such as person (22) shown in FIG. 4, can reach through openings (34) and the sleeves (36) will tend to seal the foul air within and below the shield (23) from coming out into the compartment which is generally defined as the space between outer shield (39) and floor (33). The outer shield (39) is a a frame enclosure providing space for personal lockers, drink and snack machines, and lounging area, rest rooms, etc., and is also preferable made of a clear plastic material.

Cabinet gloves (30) are sealingly attached to each of the openings (34) by seals (36).

In operation of one of the units (11), unsorted refuse would continually be dumped into the pit (13), shown in FIG. 2, and the conveyor (12) would continuously move this unsorted refuse up under the ferro-magnetic sorter (17) and its associated conveyor (16). The ferrous materials can then be sorted as necessary.

The rest of the unsorted refuse is forced into the chamber below the shield (23) and onto the main conveyor belts (18). As this refuse moves, from right to left as shown in FIG. 3, people on the stools (32) can quickly and easily see the recyclable products and place them in an appropriate opening (26). For example, one of the openings (26) could be for aluminum, another could be for one type of plastic container and another chute could be for still another type of plastic container.

Those people sorting these recyclable products can readily read the plastic numbers on the bottom of plastic bottles and containers because of the transparent shield (23). The transparent shield (23) also keeps the undesirable environment away from the worker (22), as illustrated in FIG. 4. The upper shield (39) also further shields the worker (22) from most contaminates which would enter the air either from the inlet to conveyor belts (18) or at the outlet chute (31).

When a respective one of the bins (28) is full, for example as illustrated by the dashed line bin (28) in FIG. 2, the closure member (29) can be shut and the bin removed and emptied into an appropriate place. During the time that the bin (28) is gone, the particular material designated for that particular bin (28) and chute (27) will accumulate in the chute (27) so that there is plenty of time to empty the bin (28) without fear that the sorted refuse will fall to the floor of the pit (40) while the bin (28) is being emptied.

Referring again to FIG. 1, it will be noted that each one of the units (11) would be operating just like the one unit (11) previously described. Of course, if the pit (13) is enlarged, even more units (11) could be serviced by a single pit (13).

The system disclosed in the drawings is designed to sort recycle items in a sanitary manner. A major side benefit of this process is that all of the trash is inspected for prohibitive items. Since the sorting is accomplished very shortly after the carrier dumps the unsorted material into the pit (13), it is fairly easy to trace prohibitive items back to the source and prevent the prohibited items from coming in again.

Appliances, furniture, tires, newspapers, and any other large items must be segregated first. Tree trimmings, leaves, and any other compostable materials must be shredded and composted. Used oil and other petroleum products must be disposed in a controlled manner. Leftover household chemicals, in original containers, can be sorted in the unit.

Accordingly, it will be appreciated that the preferred embodiment disclosed herein does indeed accomplish the aforementioned objects. Obviously many modifications and variations of the present invention are possible in light of the above teachings. It is therefore to be understood that, within the scope of the appended claims, the invention may be practiced otherwise than as specifically described.

I claim:

1. A sanitary trash recycling apparatus comprising:

a conveyor belt means for receiving refuse at one end thereof and moving it toward the other end thereof, said conveyor belt means being disposed along a longitudinal center line; and progressively tapered means disposed above and extending along the entire remaining length of said conveyor belt means for causing said refuse to move continuously outwardly from said longitudinal centerline as the refuse is moved from said one end to said other end of said conveyor belt means, whereby said refuse is more easily manually sorted as it is moved on said conveyor belt means; due to the fact that as refuse is removed along the conveyor belt means, at least a portion of the remaining refuse is forced outwardly along the remaining length of the conveyor belt means by continued contact with said progressively tapered means.

2. The apparatus of claim 1 wherein said tapered means comprises a rigid member which is wider and higher at said other end than at said one end.

3. The apparatus of claim 2 wherein said tapered means has a triangular cross sectional shape.

4. The apparatus of claim 1 further comprising:

a shield disposed over said conveyor belt means and said tapered means and permitting a person to see the refuse on said conveyor belt means;

a compartment means disposed adjacent to said shield for permitting one or more persons to view the refuse traveling on said conveyor belt means; and access means for permitting a person in said compartment to reach through said shield and grasp and sort refuse.

5. The apparatus of claim 4 wherein said said shield includes a shield portion which is transparent.

6. The apparatus of claim 4 including chute means disposed adjacent to the side of said conveyor belt means and inside of said shield for permitting a person to take refuse from said conveyor belt means and drop it into said chute means.

7. The apparatus of claim 6 including a plurality of chute means so that each one is to receive a different category of refuse for sorting purposes.

8. The apparatus of claim 7 including a bin means disposed below each respective one of said chute means for selectively receiving sorted refuse.

9. The apparatus of claim 8 including a closure means disposed on the lower end of each of said respective chute means for selectively opening or closing each respective one of said chute means whereby said bin means is removed and emptied while refuse accumulates in a respective one of said chute means.

10. The apparatus of claim 9 wherein said compartment includes cover means for covering said shield and anyone sorting refuse within said compartment.

11. The apparatus of claim 10 wherein at least a portion of said cover means is transparent.

12. The apparatus of claim 11 wherein said apparatus is disposed within a closed building to prevent interaction of the sorting process with normal outdoor weather conditions and to store segregated items until an economic amount is generated for baling and/or transorting.

13. The apparatus of claim 1 including outlet means disposed adjacent said other end of said conveyor belt means for receiving refuse which has not been manually removed from said conveyor belt means.

14. The apparatus of claim 1 including magnetic means disposed adjacent to said one end of said conveyor belt means for removing ferrous metallic materials and conveying these ferrous metallic materials to a place for accumulation.

15. The apparatus of claim 14 including:

a pit disposed at least partially below said conveyor belt means for receiving unsorted refuse; and conveyor means for moving said unsorted refuse to said magnetic means and ultimately to said one end of said conveyor belt means.

16. The apparatus of claim 15 wherein said pit is lined with concrete.

17. The apparatus of claim 15 wherein a plurality of said sanitary trash recycling apparatuses are disposed around said pit.

* * * * *